US011605911B2

(12) United States Patent
Yamada et al.

(10) Patent No.: US 11,605,911 B2
(45) Date of Patent: Mar. 14, 2023

(54) ELECTRICAL CONNECTOR INCLUDING PLUG CONNECTOR AND RECEPTACLE CONNECTOR DETACHABLY FITTING TO EACH OTHER

(71) Applicant: FUJIKURA LTD., Tokyo (JP)

(72) Inventors: Kiyotaka Yamada, Tokyo (JP); Soichi Sugaya, Tokyo (JP); Kazunori Takei, Tokyo (JP)

(73) Assignee: FUJIKURA LTD., Tokyo (JP)

( * ) Notice: Subject to any disclaimer, the term of this patent is extended or adjusted under 35 U.S.C. 154(b) by 70 days.

(21) Appl. No.: 17/255,388

(22) PCT Filed: May 22, 2019

(86) PCT No.: PCT/JP2019/020261

§ 371 (c)(1),
(2) Date: Dec. 22, 2020

(87) PCT Pub. No.: WO2019/244549

PCT Pub. Date: Dec. 26, 2019

(65) Prior Publication Data

US 2021/0367362 A1 Nov. 25, 2021

(30) Foreign Application Priority Data

Jun. 22, 2018 (JP) ..... JP2018-118613

(51) Int. Cl.
*H01R 12/00* (2006.01)
*H01R 12/71* (2011.01)
(Continued)

(52) U.S. Cl.
CPC ..... *H01R 12/716* (2013.01); *H01R 12/7005* (2013.01); *H01R 13/5045* (2013.01); *H01R 13/629* (2013.01); *H01R 43/16* (2013.01)

(58) Field of Classification Search
CPC ..... H01R 12/716; H01R 12/7005; H01R 13/5045; H01R 13/629; H01R 43/16; H01R 12/71; H01R 13/64
See application file for complete search history.

(56) References Cited

U.S. PATENT DOCUMENTS 6,503,101 B1 * 1/2003 Yu ..... H01R 13/6597 439/607.36
8,888,506 B2 * 11/2014 Nishimura ..... H01R 12/7082 439/74
(Continued)

FOREIGN PATENT DOCUMENTS

CN 103384036 A 11/2013
CN 203942060 U 11/2014
(Continued)

OTHER PUBLICATIONS

International Search Report and Written Opinion for related PCT App No. PCT/JP2019/020261 dated Aug. 13, 2019, 9 pgs. (partial translation).

*Primary Examiner* — Abdullah A Riyami
*Assistant Examiner* — Nelson R. Burgos-Guntin
(74) *Attorney, Agent, or Firm* — Procopio, Cory, Hargreaves & Savitch LLP

(57) ABSTRACT

An electric connector includes a plug connector 30 and a receptacle connector 20. The receptacle connector 20 has a first housing 200 having first and second recess fitting parts 203*a*, 203*b*, and a required number of first contacts 220. The first and second recess fitting parts 203*a*, 203*b* have different shapes. The receptacle connector 20 has a first cover 240 that is made of metal and covers a part of a peripheral wall 202 of the first housing 200 that defines the first recess fitting part 203*a*, and a second cover 260 that is made of metal and
(Continued)

covers a part of the peripheral wall 202 that defines the second recess fitting part 203*b*.

20 Claims, 17 Drawing Sheets

(51) Int. Cl.

| | |
|---|---|
| ***H01R 12/70*** | (2011.01) |
| ***H01R 13/504*** | (2006.01) |
| ***H01R 13/629*** | (2006.01) |
| *H01R 43/16* | (2006.01) |

(56) References Cited

U.S. PATENT DOCUMENTS

| | | | | |
|---|---|---|---|---|
| 8,986,027 | B2 * | 3/2015 | Nishimura | H01R 12/707 439/181 |
| 2005/0032400 | A1 * | 2/2005 | Zhang | H01R 12/716 439/74 |
| 2005/0042924 | A1 * | 2/2005 | Zhang | H01R 13/6582 439/607.36 |
| 2006/0063432 | A1 * | 3/2006 | Chen | H01R 13/658 439/607.36 |
| 2006/0276061 | A1 * | 12/2006 | Koguchi | H01R 12/725 439/74 |
| 2008/0207014 | A1 * | 8/2008 | Takeuchi | H01R 12/716 439/74 |
| 2008/0305657 | A1 * | 12/2008 | Midorikawa | H01R 12/57 439/74 |
| 2009/0061655 | A1 * | 3/2009 | Miyazaki | H01R 12/57 439/74 |
| 2010/0068900 | A1 * | 3/2010 | Wu | H01R 12/716 439/74 |
| 2011/0263140 | A1 * | 10/2011 | Sato | H01R 13/6275 439/74 |
| 2012/0289096 | A1 * | 11/2012 | Mashiyama | H01R 12/73 439/692 |
| 2013/0012039 | A1 * | 1/2013 | Nose | H01R 12/716 439/74 |
| 2013/0210270 | A1 | 8/2013 | Takeuchi et al. | |
| 2015/0079816 | A1 * | 3/2015 | Suzuki | H01R 12/7082 439/74 |
| 2015/0140840 | A1 * | 5/2015 | Nishimura | H01R 13/6594 439/74 |
| 2015/0140841 | A1 * | 5/2015 | Watanabe | H01R 43/18 439/74 |
| 2015/0207248 | A1 * | 7/2015 | Takenaga | H01R 13/6582 439/74 |
| 2016/0190719 | A1 * | 6/2016 | Brzezinski | H01R 12/73 439/74 |
| 2017/0033505 | A1 * | 2/2017 | Ozeki | H01R 12/716 |
| 2018/0175561 | A1 | 6/2018 | Chen | |
| 2020/0044374 | A1 * | 2/2020 | Ishida | H01R 12/721 |
| 2020/0358212 | A1 | 11/2020 | Minai et al. | |

FOREIGN PATENT DOCUMENTS

| | | | |
|---|---|---|---|
| CN | 204144493 | U | 2/2015 |
| CN | 204538360 | U | 8/2015 |
| CN | 106025710 | A | 10/2016 |
| CN | 206595493 | U | 10/2017 |
| JP | 45002389 | U | 5/1992 |
| JP | 2001517352 | A | 10/2001 |
| JP | 20129373 | A | 1/2012 |
| JP | 2012238519 | A | 12/2012 |
| JP | 2013232372 | A | 11/2013 |
| JP | 2016189244 | A | 11/2016 |
| TW | 201807894 | A | 3/2018 |
| WO | 2017188054 | A1 | 11/2017 |

* cited by examiner

A-A section

B-B section

C-C section

D-D section

E-E section

F-F section

G-G section

H-H section

ELECTRICAL CONNECTOR INCLUDING PLUG CONNECTOR AND RECEPTACLE CONNECTOR DETACHABLY FITTING TO EACH OTHER

CROSS-REFERENCE TO RELATED APPLICATIONS

This application is a U.S. National Stage entry of PCT Application No: PCT/JP2019/020261 filed May 22, 2019, which claims priority to Japanese Patent Application No. 2018-118613 filed Jun. 22, 2018, the contents of which are incorporated herein by reference.

TECHNICAL FIELD

The present invention relates to an electrical connector including a plug connector and a receptacle connector that are detachably fit to each other.

BACKGROUND ART

Among conventional electrical connectors of this type, there is one of which the receptacle connector has an electrically insulating housing that has a recess fitting part formed at each end in a longitudinal direction of a recess defined by a peripheral wall and a bottom wall, and a required number of contacts that are arrayed and retained between the recess fitting parts of the housing, and of which the plug connector has a housing that has a convex fitting part formed at each end in a longitudinal direction and inserted into the recess fitting part of the receptacle connector, and a required number of contacts that are arrayed and retained between the convex fitting parts of the housing (see, e.g., Patent Literature 1).

CITATION LIST

Patent Literature

Patent Literature 1: JP-A-2012-238519

SUMMARY OF INVENTION

Technical Problem

As a recent trend, electrical connectors have been reduced in size and their strength has decreased accordingly. In such an electrical connector, if a key is formed in one of the housings of the plug connector and the receptacle connector and a key groove matching the key is formed in the other housing to prevent incorrect fitting of fitting the plug connector and the receptacle connector to each other in the wrong direction, the part where the key groove is formed is further reduced in strength and may break when the plug connector and the receptacle connector are fit to each other. Preventing this requires setting the thickness of the housing in which the key groove is to be formed to be large from the beginning such that predetermined strength can be secured even when the key groove is formed. In this case, however, the outer shape of the housing becomes larger, which is contrary to the purpose of reducing the size of the electrical connector.

Therefore, an object of the present invention is to provide an electrical connector that can prevent incorrect fitting of the plug connector and the receptacle connector while meeting the requirement of reducing the size of the electrical connector.

Solution to Problem

The present invention is an electrical connector including a plug connector and a receptacle connector that are detachably fit to each other. The receptacle connector has: a first housing having a recess defined by a bottom wall and a peripheral wall rising from the bottom wall, with one end part of the recess in a longitudinal direction forming a first recess fitting part and the other end part forming a second recess fitting part; and a required number of first contacts that are arrayed and retained between the first and second recess fitting parts of the first housing. The plug connector has: a second housing having a first convex fitting part that is detachably inserted into the first recess fitting part and a second convex fitting part that is detachably inserted into the second recess fitting part; and a required number of second contacts that are arrayed and retained between the first and second convex fitting parts of the second housing and come into contact with the first contacts when the plug connector and the receptacle connector are fit to each other. The first and second recess fitting parts have different shapes. The receptacle connector has a first cover that is made of metal and covers a part of the peripheral wall that defines the first recess fitting part, and a second cover that is made of metal and covers a part of the peripheral wall that defines the second recess fitting part.

In the electrical connector of the present invention, it is preferable that the wall thickness of a part of the peripheral wall that corresponds to the first recess fitting part be smaller than the wall thickness of a part of the peripheral wall that corresponds to the second recess fitting part such that the width dimension of the first recess fitting part is larger than the width dimension of the second recess fitting part; and that the first cover be formed so as to at least partially hold the part of the peripheral wall that corresponds to the first recess fitting part from both an inner surface and an outer surface of the part.

In the electrical connector of the present invention, it is preferable that the first and second recess fitting parts be different from each other in length dimension.

In the electrical connector of the present invention, it is preferable that the first and second convex fitting parts have different shapes, and that the plug connector have a third cover that is made of metal and covers the first convex fitting part and a fourth cover that is made of metal and covers the second convex fitting part.

In the electrical connector of the present invention, it is preferable that the first and second convex fitting parts be different from each other in width dimension and/or length dimension.

In the electrical connector of the present invention, it is preferable that the first housing have a raised part that is formed on the bottom wall, separated from the peripheral wall, and that the raised part be formed asymmetrically with respect to the center of the recess in the longitudinal direction.

In the electrical connector of the present invention, it is preferable that the fit height of the plug connector and the receptacle connector are fit be not more than 0.7 mm.

Advantageous Effects of Invention

According to the electrical connector of the present invention, the first recess fitting part and the second recess fitting part have different shapes, which can prevent incorrect fitting of the plug connector and the receptacle connector. Even when the thickness of the first housing is reduced so that the shapes of the first recess fitting part and the second recess fitting part have different shapes, the first housing can be reinforced by the first and second covers that are made of metal and have higher rigidity than the first housing. Thus, it is possible to secure desired rigidity of the receptacle connector while avoiding increasing the size of the first housing.

DESCRIPTION OF EMBODIMENTS

An embodiment of an electrical connector of the present invention will be described in detail below based on the drawings. The electrical connector of one embodiment of the present invention is a substrate-to-substrate connector that includes a receptacle connector and a plug connector to be separately mounted to two substrates (not shown) and that electrically connects the two substrates as the receptacle connector and the plug connector are coupled to each other. The type and form of the substrates are not particularly limited as long as the receptacle connector and the plug connector can be mounted thereon. For example, the substrates may be rigid substrates, flexible substrates (FPCs), or rigid flexible substrates (rigid FPC). In the following description, bottom surfaces or lower surfaces of the receptacle connector and the plug connector refer to surfaces on a side to be mounted to the substrate, and upper surfaces thereof refer to surfaces on the opposite side from the bottom surfaces. The mounting method is not limited to a surface mounting method of soldering a connector to a surface of a substrate, but may also be, for example, a dip method of soldering a connector inserted in a through-hole of a substrate, or a press fitting of fitting a connector by pressure.

Figure 1A:
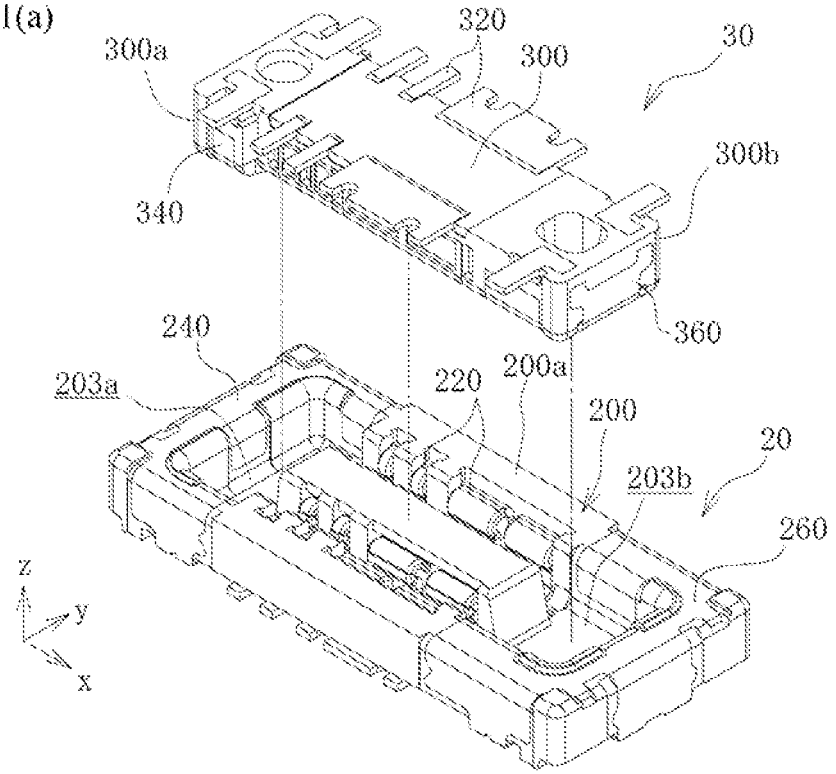
FIG. 1 shows an electrical connector of one embodiment of the present invention, with FIG. 1(*a*) being a perspective view showing a disconnected state and FIG. 1(*b*) being a perspective view showing a connected state.
Figure 1B:
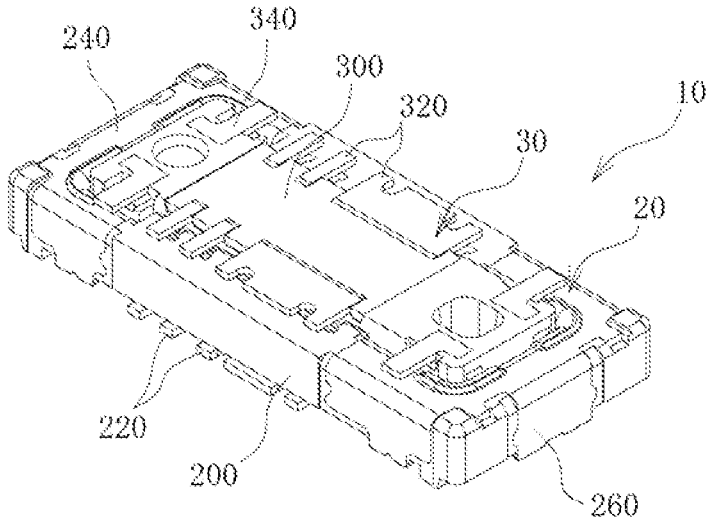
Figure 2A:
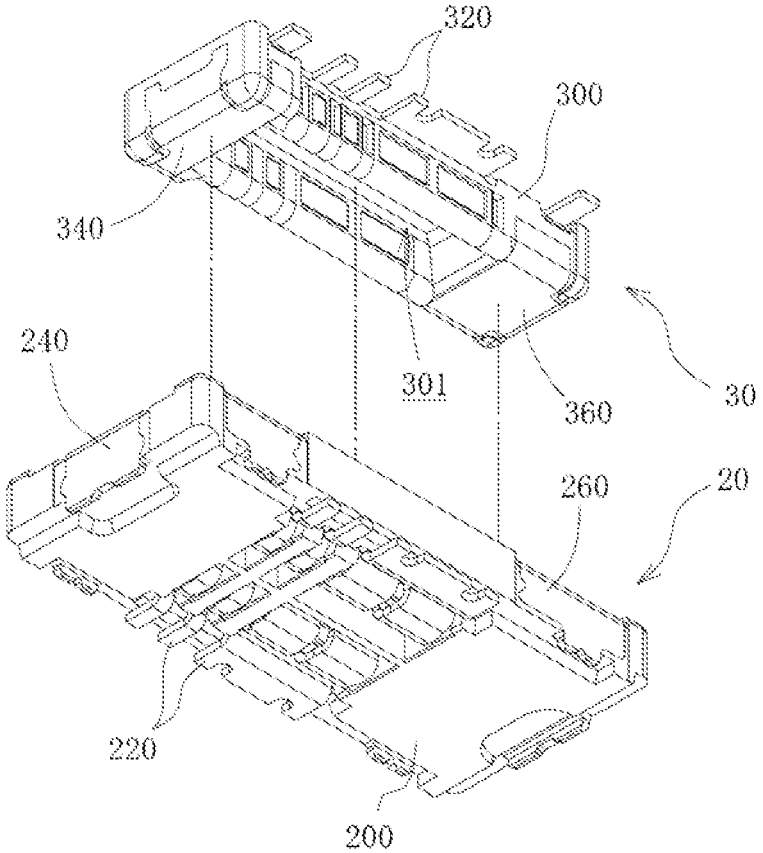
FIG. 2 shows the electrical connector of one embodiment of the present invention, with (a) being a perspective view showing the disconnected state and (b) being a perspective view showing the connected state.
Figure 2B:
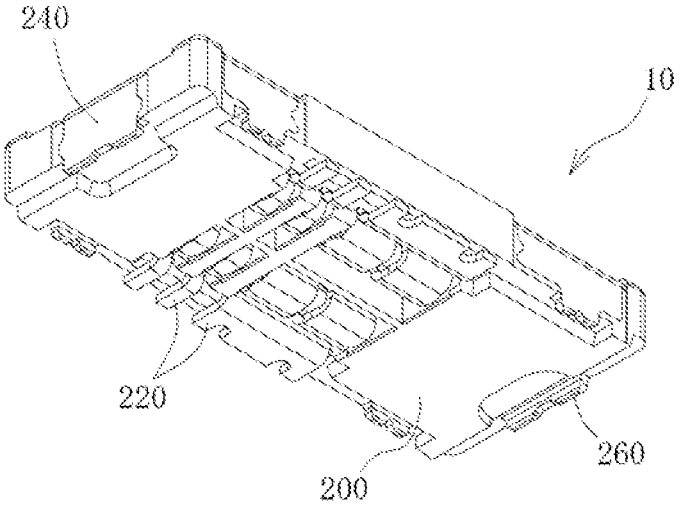

FIG. 1(*a*) and FIG. 2(*a*) show a receptacle connector 20 and a plug connector 30 composing an electrical connector 10 in a separated state (disconnected state). FIG. 1(*b*) and FIG. 2(*b*) show the plug connector 30 and the receptacle connector 20 in a state of being fit and coupled to each other (connected state). The receptacle connector 20 and the plug connector 30 can be detachable to each other.

As shown in FIG. 1 and FIG. 2, the receptacle connector 20 mainly includes a first housing 200, a required number of first contacts 220, a first cover 240, and a second cover 260.

The plug connector 30 mainly includes a second housing 300, a required number of second contacts 320, a third cover 340, and a fourth cover 360.

Figure 3A:
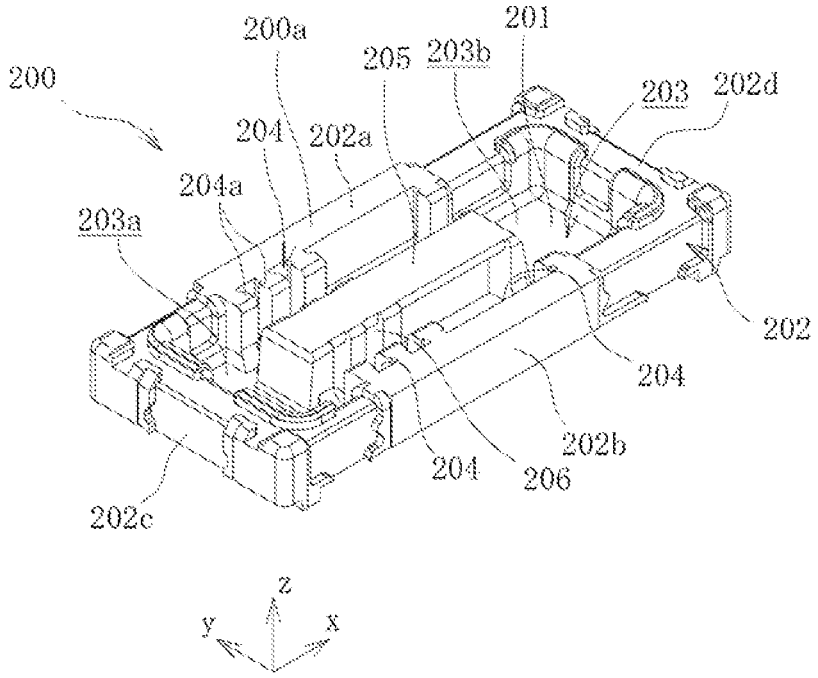
FIG. 3 shows a first housing of a receptacle connector of FIGS. 1 and 2, with FIG. 3(*a*) being a perspective view of an upper surface side and FIG. 3(*b*) being a perspective view of a bottom surface side.
Figure 3B:
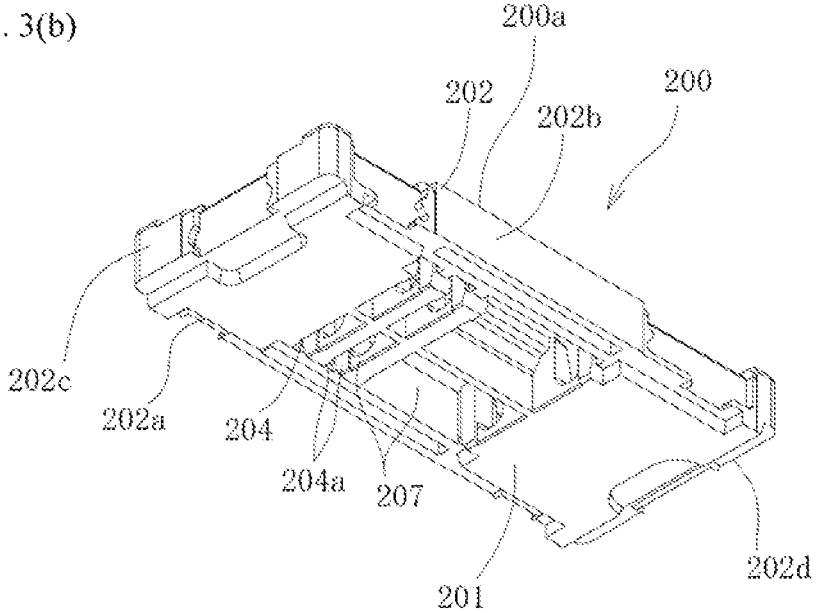
Figure 4A:
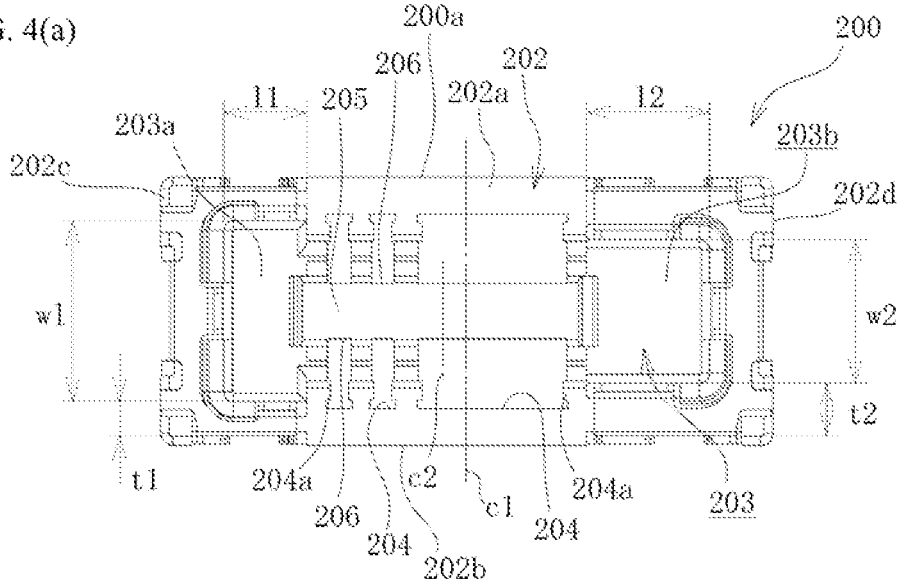
FIG. 4 shows the first housing of the receptacle connector of FIGS. 1 and 2, with FIG. 4(*a*) being a plan view and FIG. 4(*b*) being a bottom view.
Figure 4B:
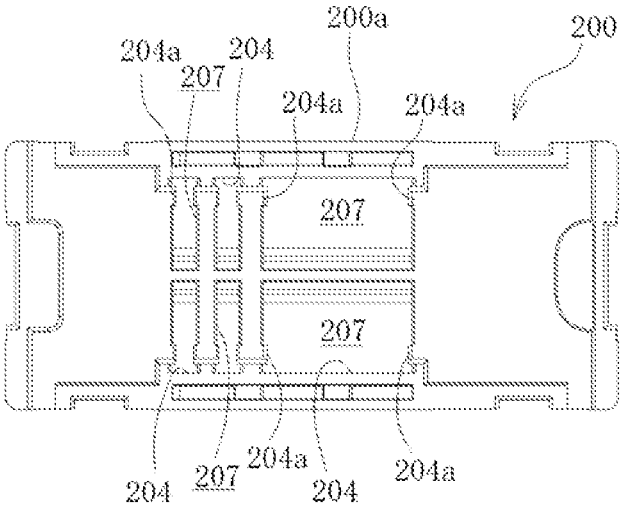

Details of the receptacle connector 20 will be described with reference to FIG. 3 to FIG. 9. FIG. 3 and FIG. 4 show the first housing 200 alone for the convenience of description. The first housing 200 is produced by injection shaping or the like using an electrically insulating synthetic resin as the material. Examples of the synthetic resin material include, but are not limited to, liquid crystal polymer, polyphenylene sulfide, polybutylene terephthalate, and polyamide. The material of the first housing 200 may contain an inorganic filler, reinforcing fibers, etc.

The first housing 200 has a flat, substantially rectangular parallelepiped outer shape. The first housing 200 has a bottom wall 201 and a peripheral wall 202 rising from a peripheral edge of the bottom wall 201. The bottom wall 201 and the peripheral wall 202 define a recess 203 that opens in an upper surface. Of the recess 203 of the first housing 200, one end part in an x-direction that is a longitudinal direction forms a first recess fitting part 203*a* into which a first convex fitting part 300*a*, to be described later, of the plug connector 30 is inserted, and the other end part forms a second recess fitting part 203*b* into which a second convex fitting part 300*b*, to be described later, of the plug connector 30 is inserted. The first contacts 220 are provided in a first middle part 200*a* located between the first recess fitting part 203*a* and the second recess fitting part 203*b* of the first housing 200, with an array pitch oriented along the longitudinal direction.

The first recess fitting part 203*a* and the second recess fitting part 203*b* have different shapes as seen in a plan view. As shown in FIG. 4(*a*), it is preferable that a width dimension (a dimension in a y-direction) w1 of the first recess fitting part 203*a* and a width dimension (a dimension in the y-direction) w2 of the second recess fitting part 203*b* be different from each other. In the shown example, the width dimension w1 of the first recess fitting part 203*a* is larger than the width dimension w2 of the second recess fitting part 203*b*. It is preferable that a length dimension (a dimension in the x-direction) l1 of the first recess fitting part 203*a* and a length dimension (a dimension in the x-direction) l2 of the second recess fitting part 203*b* be different from each other. In the shown example, the length dimension l1 of the first recess fitting part 203*a* is smaller than the length dimension l2 of the second recess fitting part 203*b*. The length dimension l1 of the first recess fitting part 203*a* may be equal to or larger than the length dimension l2 of the second recess fitting part 203*b*. Thus, in the shown example, the width dimension w1 of the first recess fitting part 203*a* and the width dimension w2 of the second recess fitting part 203*b*, as well as the length dimension l1 of the first recess fitting part 203*a* and the length dimension l2 of the second recess fitting part 203*b*, are varied from each other, so that the first recess fitting part 203*a* and the second recess fitting part 203*b* have different shapes.

The peripheral wall 202 has first and second side walls 202*a*, 202*b* that extend in the longitudinal direction (x-direction) and face each other, and first and second end walls 202*c*, 202*d* that extend in the widthwise direction (y-direction) orthogonal to the longitudinal direction and couple the first and second side walls 202*a*, 202*b* to each other at their ends in the longitudinal direction. Outer housing grooves 204 that house retained parts 225, to be described later, that are outer parts of the required number of first contacts 220 are formed at parts of the first and second side walls 202*a*, 202*b* that correspond to the first middle part 200*a*. The outer housing grooves 204 extend in a z-direction that is a height direction of the first housing 200. In a case where the first contacts 220 are assembled in in the outer housing grooves 204 by insertion, the outer housing grooves 204 preferably have such a dimension as to come into pressure-contact with the retained parts 225. Instead of this, the first contacts 220 can also be integrated at the time of injection shaping of the first housing 200. Specifically, the first contacts 220 may be fixed to the first housing 200 by retaining the first contacts 220 as insert bodies in a mold (not shown) and injecting the synthetic resin material of the first housing 200 around the first contacts 220. Projections 204*a* that reduce the opening width are formed at portions of the outer housing grooves 204 on the side of the recess 203. Thus, the retained parts 225 of the first contacts 220 engage with the projections 204*a*, so that the first contacts 220 are more reliably prevented, particularly before mounting, from coming off the outer housing grooves 204.

A wall thickness t1 of parts of the first and second side walls 202*a*, 202*b* that correspond to the first recess fitting part 203*a* is smaller than a wall thickness t2 of parts of the side walls 202*a*, 202*b* that correspond to the second recess fitting part 203*b*. Therefore, as described above, the width dimension w1 of the first recess fitting part 203*a* is larger than the width dimension w2 of the second recess fitting part 203*b*. To make the width dimension w1 of the first recess fitting part 203*a* larger than the width dimension w2 of the second recess fitting part 203*b*, the wall thickness t1 of the part of either the first side wall 202*a* or the second side wall 202*b* that corresponds to the first recess fitting part 203*a* may be made smaller than the wall thickness t2 of the part of either the side wall 202*a* or the side wall 202*b* that corresponds to the second recess fitting part 203*b* (not shown).

The first housing 200 has a raised part 205 that has a rectangular shape as seen in a plan view and is formed on the bottom wall 201, separated from the peripheral wall 202. Thus, the recess 203 has an annular shape. To support the first contacts 220, the raised part 205 is formed in a region of the first housing 200 that corresponds to the first middle part 200*a*. Inner housing grooves 206 that house inner parts of the first contacts 220 in the y-direction are formed in side surfaces of the raised part 205 that face the first and second side walls 202*a*, 202*b*. The inner housing grooves 206 extend in the z-direction at positions facing the outer housing grooves 204. In a case where the first contacts 220 are assembled in the inner housing grooves 206 by insertion, the inner housing grooves 206 preferably have such a dimension as to come into pressure-contact with the first contacts 220.

As shown in FIG. 4(*a*), it is preferable that the raised part 205 be formed asymmetrically with respect to a center c1 of the recess 203 of the first housing 200 in the longitudinal direction. In other words, a center c2 of the raised part 205 in the longitudinal direction is offset from the center c1 of the recess 203 in the longitudinal direction. In the shown example, the center c2 of the raised part 205 in the longitudinal direction is offset from the center c1 of the recess 203 in the longitudinal direction toward the first recess fitting part 203*a*.

As shown in FIG. 3(*b*) and FIG. 4, openings 207 communicating with the outer housing grooves 204 and the inner housing grooves 206 are formed at parts of the bottom wall 201 that correspond to the first middle part 200*a* of the first housing 200. In a case where the first contacts 220 are assembled in the first housing 200 by insertion, the first contacts 220 may be inserted from the side of the bottom surface through these openings 207.

Back to FIG. 1 and FIG. 2, the first and second covers 240, 260 partially cover end parts of the first housing 200 in the longitudinal direction. Thus, the parts of the peripheral wall 202 of the first housing 200 that define the first recess fitting part 203*a* and the second recess fitting part 203*b* are reinforced. The first and second covers 240, 260 function also as fixing tabs for fixing the first housing 200 to the substrate.

Figure 5A:
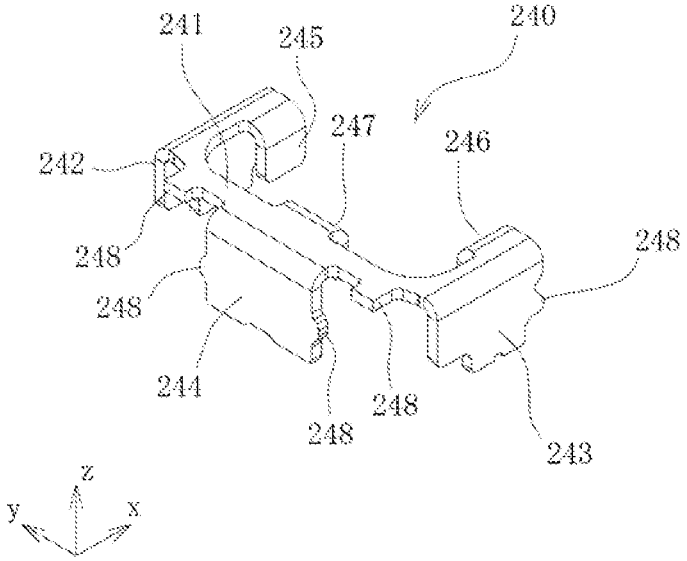
FIG. 5 shows a first cover of the receptacle connector of FIGS. 1 and 2, with FIG. 5(*a*) being a perspective view of an upper surface side and FIG. 5(*b*) being a perspective view of a bottom surface side.
Figure 5B:
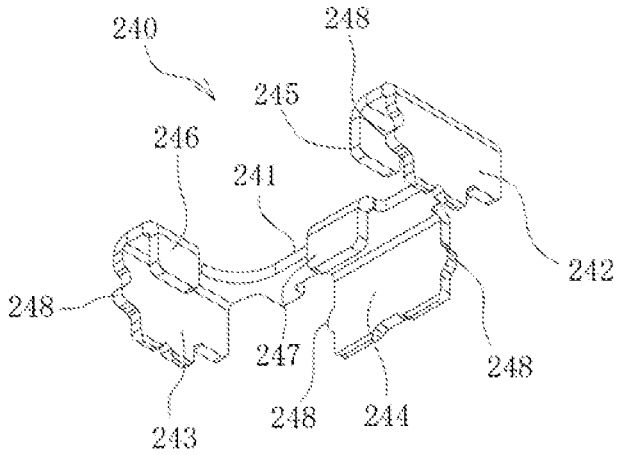

FIG. 5 shows the first cover 240 alone. The first cover 240 is integrated with the first housing 200 at the time of injection shaping of the first housing 200. Specifically, the first cover 240 is fixed to the first housing 200 by retaining the first cover 240 as an insert body in a mold (not shown) and injecting the synthetic resin material of the first housing 200 around the first cover 240. Instead of this, the first cover 240 may be fixed to the first housing 200 by fitting and/or bonding after the first housing 200 is formed. The first cover 240 is formed by bending a sheet member that is made of metal, such as copper or copper alloy, and cut into a predetermined shape with predetermined dimensions. The first cover 240 has: a first top plate 241 that has a substantially C-shape as seen in a plan view and is disposed on an upper surface of the part of the peripheral wall 202 that defines the first recess fitting part 203*a* of the first housing 200; first and second outer downward-bent pieces 242, 243 that bend downward from opposite two sides of the first top plate 241 along outer surfaces of the side walls 202*a*, 202*b*, respectively, of the peripheral wall 202 and are fixed to the substrates at the time of mounting; and a third outer downward-bent piece 244 that bends downward from the other one side of the first top plate 241 along an outer surface of the first end wall 202*c* of the peripheral wall 202 and is fixed to the substrate at the time of mounting. An outer surface of the first top plate 241 and outer surfaces of the first to third outer downward-bent pieces 242 to 244 are flush with an outer surface of the first housing 200 (see FIGS. 1 and 2).

The first cover 240 further has first and second inner downward-bent pieces 245, 246 that bend downward from the first top plate 241 at positions facing the first and second outer downward-bent pieces 242, 243, respectively. Thus, the part of the first side wall 202*a* that corresponds to the first recess fitting part 203*a* is at least partially held between the first outer downward-bent piece 242 and the first inner downward-bent piece 245 and reinforced. The part of the second side wall 202*b* that corresponds to the first recess fitting part 203*a* is at least partially held between the second outer downward-bent piece 243 and the second inner downward-bent piece 246 and reinforced. Outer surfaces of the first and second inner downward-bent pieces 245, 246 are flush with an inner surface of the first housing 200 (the surface defining the recess 203).

The first cover 240 further has a third inner downward-bent piece 247 that bends downward from the first top plate 241 at a position facing the third outer downward-bent piece 244. Thus, the first end wall 202*c* of the peripheral wall 202 is at least partially held between the third outer downward-bent piece 244 and the third inner downward-bent piece 247 and reinforced. An outer surface of the third inner downward-bent piece 247 is flush with the inner surface of the first housing 200 (the surface defining the recess 203).

The first cover 240 may further have at least one engaging portion 248 that is extended or recessed along a surface of the first cover 240 and engages with the first housing 200. Thus, fixation between the first cover 240 and the first housing 200 is enhanced, so that the first housing 200 is less likely to shift at the time of fitting or releasing between the plug connector 30 and the receptacle connector 20. In the shown example, the engaging portions 248 are formed at positions in the first top plate 241 on both sides of the third outer downward-bent piece 244, on side edges of the first and second outer downward-bent pieces 242, 243, and on both side edges of the third outer downward-bent piece 244. Without being limited to these locations, the engaging portions 248 may be formed in the first to third inner downward-bent pieces 245 to 247.

Figure 6A:
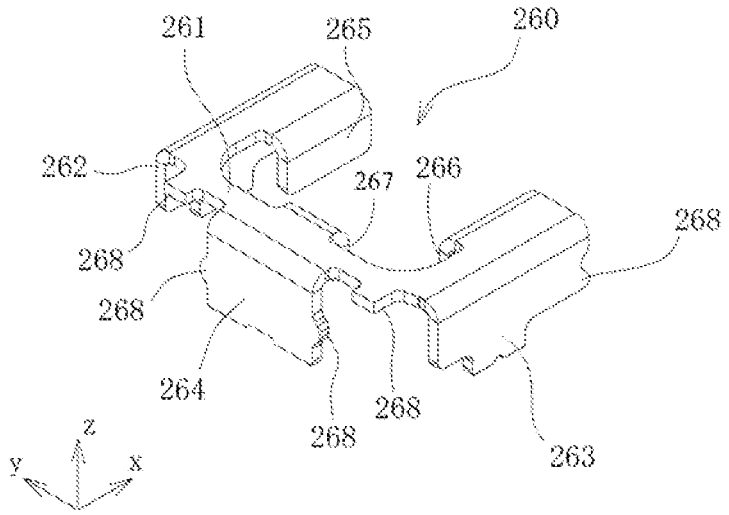
FIG. 6 shows a second cover of the receptacle connector of FIGS. 1 and 2, with FIG. 6(*a*) being a perspective view of an upper surface side and FIG. 6(*b*) being a perspective view of a bottom surface side.
Figure 6B:
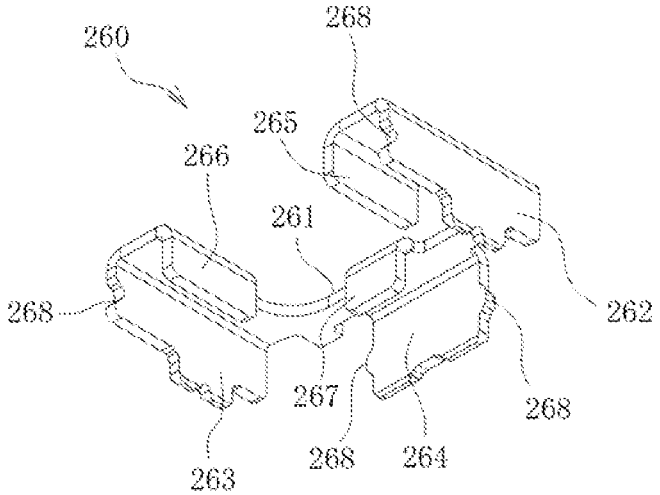

FIG. 6 shows the second cover 260 alone. The second cover 260 has the same structure as the first cover 240, except that the length dimension (the length in the x-direction) of the second cover 260 is larger than the length dimension (the length in the x-direction) of the first cover 240. The second cover 260 is integrated with the first housing 200 at the time of injection shaping of the first housing 200. Specifically, the second cover 260 is fixed to the first housing 200 by retaining the second cover 260 as an insert body in a mold (not shown) and injecting the synthetic resin material of the first housing 200 around the second cover 260. Instead of this, the second cover 260 may be fixed to the first housing 200 by fitting and/or bonding after the first housing 200 is formed. The second cover 260 is formed by bending a sheet member that is made of metal, such as copper or copper alloy, and cut into a predetermined shape with predetermined dimensions. The second cover 260 has: a second top plate 261 that has a substantially C-shape as seen in a plan view and is disposed on an upper surface of the part of the peripheral wall 202 that defines the second recess fitting part 203*b* of the first housing 200; fourth and fifth outer downward-bent pieces 262, 263 that bend downward from opposite two sides of the second top plate 261 along the outer surfaces of the first and second side walls 202*a*, 202*b*, respectively, and are fixed to the substrate at the time of mounting; and a sixth outer downward-bent piece 264 that bends downward from the other one side of the second top plate 261 along an outer surface of the second end wall 202*d* of the peripheral wall 202 and is fixed to the substrate at the time of mounting. An outer surface of the second top plate 261 and outer surfaces of the fourth to sixth outer downward-bent pieces 262 to 264 are flush with the outer surface of the first housing 200 (see FIGS. 1 and 2).

The second cover 260 further has fourth and fifth inner downward-bent pieces 265, 266 that bend downward from the second top plate 261 at positions facing the fourth and fifth outer downward-bent pieces 262, 263, respectively. Thus, the part of the second side wall 202*b* that corresponds to the second recess fitting part 203*b* is at least partially held between the fourth outer downward-bent piece 262 and the fourth inner downward-bent piece 265 and reinforced. The part of the first side wall 202*a* that corresponds to the second recess fitting part 203*b* is at least partially held between the fifth outer downward-bent piece 263 and the fifth inner downward-bent piece 266 and reinforced. Outer surfaces of the fourth and fifth inner downward-bent pieces 265, 266 are flush with the inner surface of the first housing 200 (the surface defining the recess 203).

The second cover 260 further has a sixth inner downward-bent piece 267 that bends downward from the second top plate 261 at a position facing the sixth outer downward-bent piece 264. Thus, the second end wall 202*d* of the peripheral wall 202 is at least partially held between the sixth outer downward-bent piece 264 and the sixth inner downward-bent piece 267 and reinforced. An outer surface of the sixth inner downward-bent piece 267 is flush with the inner surface of the first housing 200 (the surface defining the recess 203).

The second cover 260 may further have at least one engaging portion 268 that is extended or recessed along a surface of the second cover 260 and engages with the first housing 200. Thus, fixation between the second cover 260 and the first housing 200 is enhanced, so that the first housing 200 is less likely to shift at the time of fitting or releasing between the plug connector 30 and the receptacle connector 20. In the shown example, the engaging portions 268 are formed at positions in the second top plate 261 on both sides of the sixth outer downward-bent piece 264, on side edges of the fourth and fifth outer downward-bent pieces 262, 263, and on both side edges of the sixth outer downward-bent piece 264. Without being limited to these locations, the engaging portions 268 may be formed in the fourth to sixth inner downward-bent pieces 265 to 267.

Figure 7A:
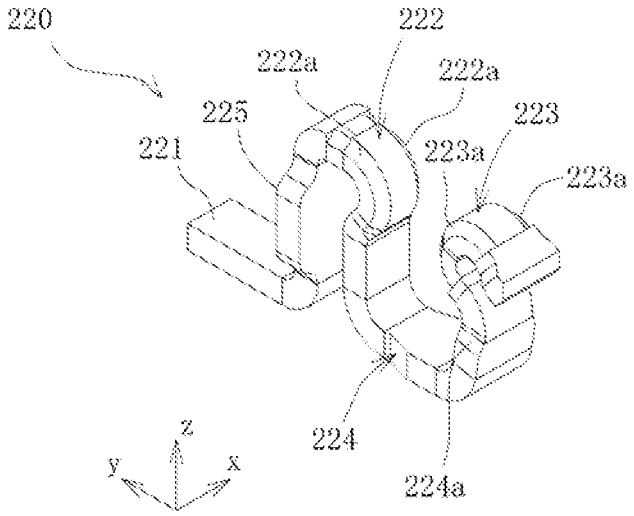
FIG. 7 shows a narrow-type first contact of the receptacle connector of FIGS. 1 and 2, with (a) being a perspective view of an upper surface side and (b) being a perspective view of a bottom surface side.
Figure 7B:
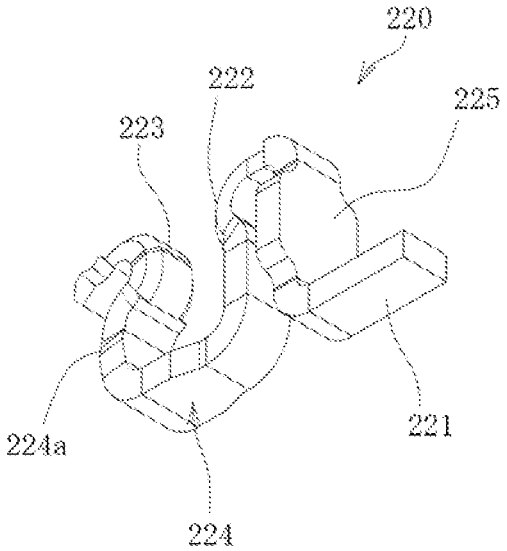
Figure 8A:
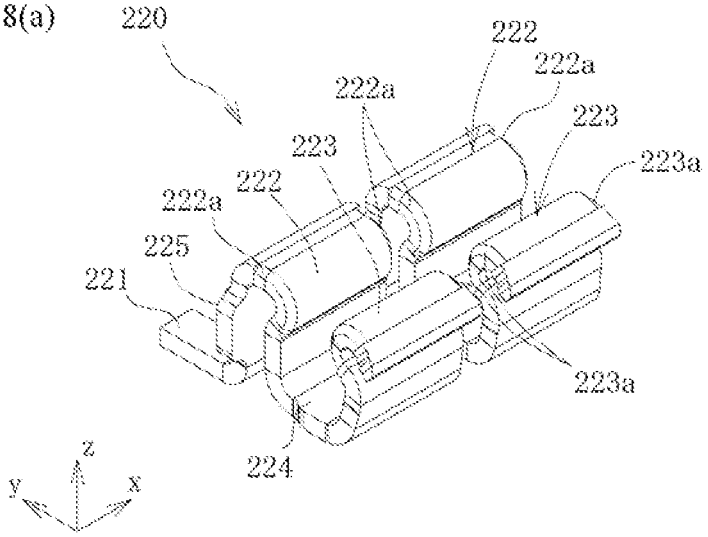
FIG. 8 shows a wide-type first contact of the receptacle connector of FIGS. 1 and 2, with FIG. 8(*a*) being a perspective view of an upper surface side and FIG. 8(*b*) being a perspective view of a bottom surface side.
Figure 8B:
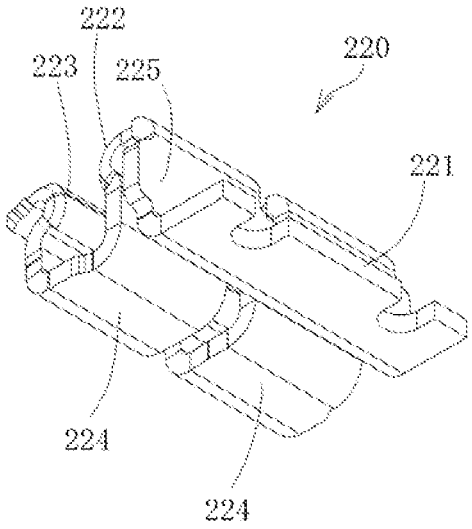
Figure 9A:
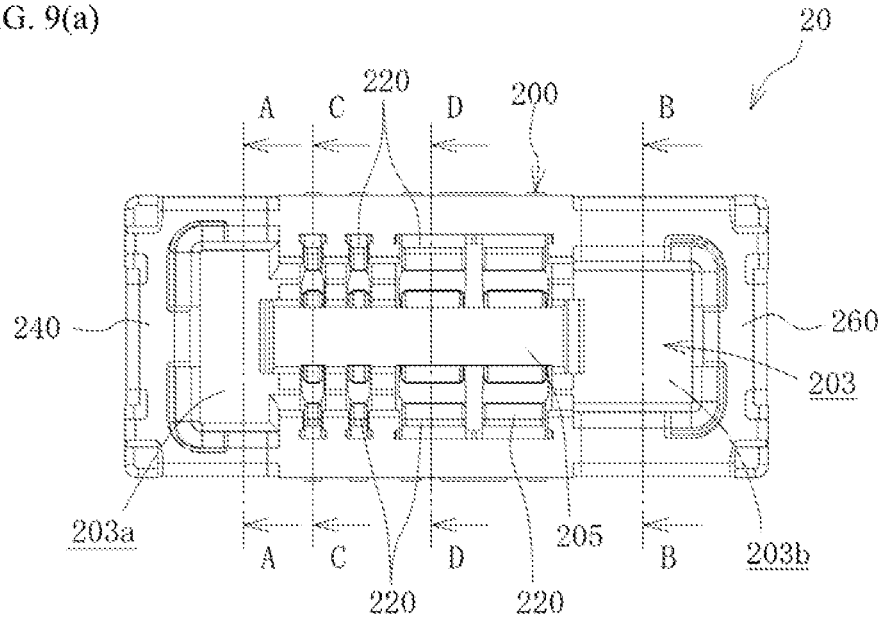
FIG. 9 shows the receptacle connector in the electrical connector of FIGS. 1 and 2, with FIG. 9(*a*) being a plan view, FIG. 9(*b*) being a sectional view taken along line A-A in FIG. 9(*a*), FIG. 9(*c*) being a sectional view taken along line B-B in FIG. 9(*a*), FIG. 9(*d*) being a sectional view taken along line C-C in FIG. 9(*a*), and FIG. 9(*e*) being a sectional view taken along line D-D in FIG. 9(*a*).
Figure 9B:
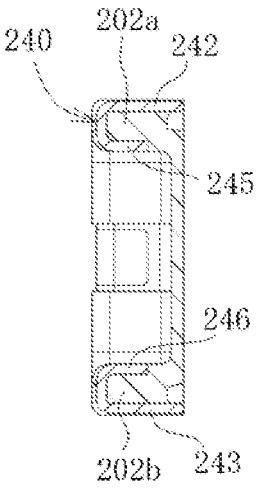
Figure 9C:
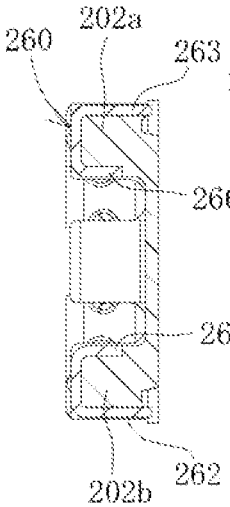
Figure 9D:
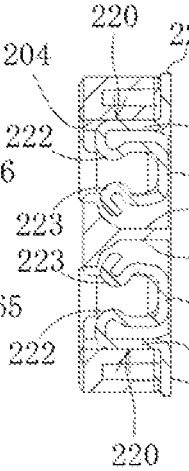
Figure 9E:
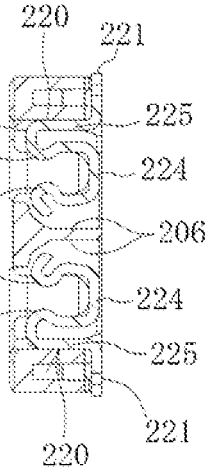

The first contacts 220 may include a narrow signal contact as shown in FIG. 7 and a wide power source contact as shown in FIG. 8. The signal contact and the power source contact may have the same width. The first contacts 220 are made of conductive metal, for example, copper or copper alloy. Each first contact 220 has: a first connecting part 221 that is mounted to the substrate; first and second contacting parts 222, 223 that face each other in the y-direction and have an arc-shaped cross-section in the y-direction, and h third and fourth contacting parts 322, 323, to be described later, of the second contact 320, in contact therewith; a first coupling part 224 that is formed by a substantially C-shaped leaf spring and elastically couples the first and second contacting parts 222, 223 to each other; and the retained part 225 that extends in the y-direction between the first connecting part 221 and the first contacting part 222 and is locked in the outer housing groove 204 of the first housing 200. To engage with the projections 204*a* of the outer housing groove 204, the retained part 225 is formed to be wider than the other parts. The first coupling part 224 may have a wide engaging portion 224*a* that is provided at a portion adjoining the second contacting part 223 and engages with the first housing 200 to prevent lifting at the time of extracting the second contact 320.

The first contacting part 222 has a chamfer 222*a* formed along a ridge line on an upper surface side to facilitate insertion as well as elastic deformation of the second contact 320. The second contacting part 223 also has a chamfer 223*a* formed along a ridge line on an upper surface side to facilitate insertion as well as elastic deformation of the second contact 320. Although this is not shown, the first coupling part 224 may also have a similar chamfer formed on a lower surface side, for example.

In the case of the wide first contact 220 shown in FIG. 8, to cause uniform elastic deformation of the first and second contacting parts 222, 223 and the first coupling part 224, it is preferable that a plurality of the first and second contacting parts 222, 223 and the first coupling part 224 be provided for one first retained part 225. In the example of FIG. 8, the first contact 220 has two each of the first and second contacting parts 222, 223 and the first coupling parts 224 for one first retained part 225.

FIG. 9 shows the receptacle connector 20 in which the first and second covers 240, 260 are integrated with the first housing 200 and the first contacts 220 are assembled in the first housing 200. FIG. 9(*a*) is a plan view of the receptacle connector 20, FIG. 9(*b*) is a sectional view taken along line A-A in FIG. 9(*a*), FIG. 9(*c*) is a sectional view taken along line B-B in FIG. 9(*a*), FIG. 9(*d*) is a sectional view taken along line C-C in FIG. 9(*a*), and FIG. 9(*e*) is a sectional view taken along line D-D in FIG. 9(*a*).

It can be seen from FIG. 9(*b*) that the first side wall 202*a* is held between the first outer downward-bent piece 242 and the first inner downward-bent piece 245 of the first cover 240, and that the second side wall 202*b* is held between the second outer downward-bent piece 243 and the second inner downward-bent piece 246 of the first cover 240.

It can be seen from FIG. 9(*c*) that the second side wall 202*b* is held between the fourth outer downward-bent piece 262 and the fourth inner downward-bent piece 265 of the second cover 260, and that the first side wall 202*a* is held between the fifth outer downward-bent piece 263 and the fifth inner downward-bent piece 266 of the second cover 260.

It can be seen from FIGS. 9(*d*) and (*e*) that the retained parts 225 of the first contacts 220 are housed inside the outer housing grooves 204 of the first housing 200, and that the second contacting parts 223 and the first coupling parts 224 of the first contacts 220 are partially housed inside the inner housing grooves 206 of the first housing 200. It can also be seen that, to come into contact with the second contacts 320, the first and second contacting parts 222, 223 are partially exposed (protrude) to the recess 203.

Figure 10A:
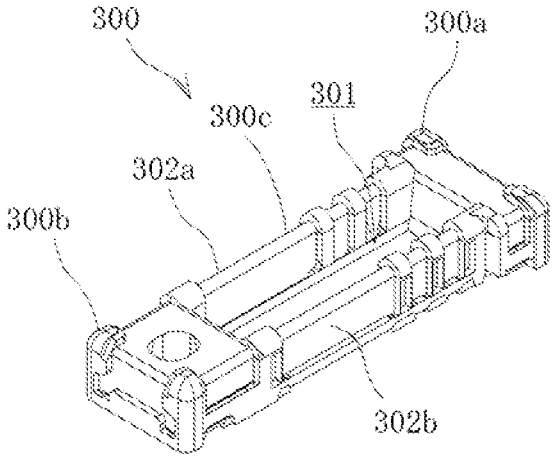
FIG. 10 shows a second housing of the plug connector of FIGS. 1 and 2, with FIG. 10(*a*) being a perspective view of an upper surface side and FIG. 10(*b*) being a perspective view of a bottom surface side.
Figure 10B:
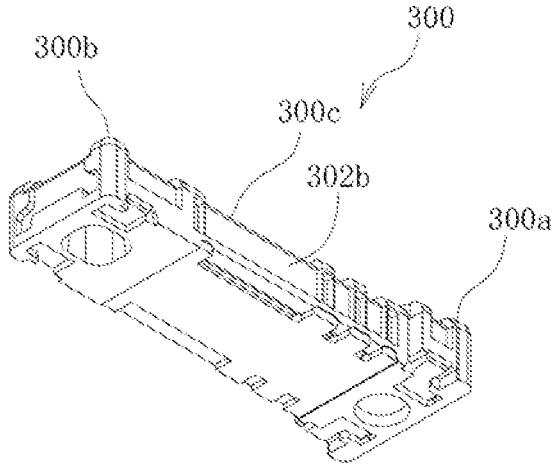

Next, details of the plug connector 30 will be described with reference to FIG. 10 to FIG. 16. FIG. 10 shows the second housing 300 alone. The second housing 300 is manufactured by injection shaping or the like using an electrically insulating synthetic resin as the material. Examples of the material of the second housing 300 include, but are not limited to, liquid crystal polymer, polyphenylene sulfide, polybutylene terephthalate, and polyamide. The material of the second housing 300 may contain an inorganic filler, reinforcing fibers, etc.

The second housing 300 has a flat, substantially rectangular parallelepiped outer shape that conforms to the recess 203 of the first housing 200. At one end of the second housing 300 in a longitudinal direction (x-direction), a first convex fitting part 300*a* that is inserted into the first recess fitting part 203*a* of the receptacle connector 20 is formed, and at the other end in the longitudinal direction, a second convex fitting part 300*b* that is inserted into the second recess fitting part 203*b* of the receptacle connector 20 is formed. The first convex fitting part 300*a* is shaped so as to be fit to the first recess fitting part 203*a*, and the second convex fitting part 300*b* is shaped so as to be fit to the second recess fitting part 203*b*.

In a second middle part 300*c* between the first convex fitting part 300*a* and the second convex fitting part 300*b*, two side walls 302*a*, 302*b* are formed that extend in the longitudinal direction (x-direction) and define a recessed part 301 into which the raised part 205 of the first housing 200 is inserted.

Figure 11A:
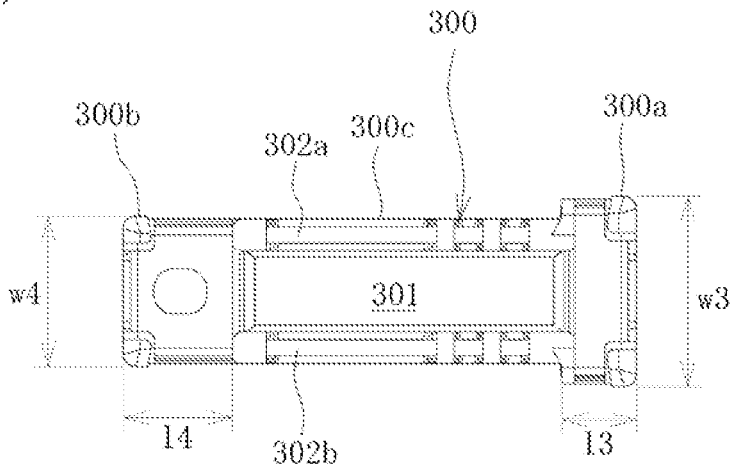
FIG. 11 shows the second housing of the plug connector of FIGS. 1 and 2, with FIG. 11(*a*) being a plan view and FIG. 11(*b*) being a bottom view.
Figure 11B:
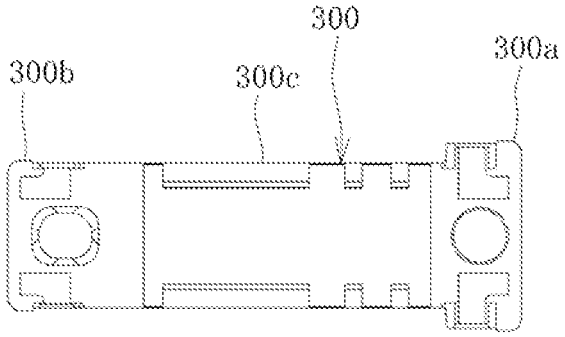

The first convex fitting part 300*a* and the second convex fitting part 300*b* have different shapes so as to correspond to the first recess fitting part 203*a* and the second recess fitting part 203*b* of the receptacle connector 20 having different shapes as described above. Thus, connection of the plug connector 30 and the receptacle connector 20 in the wrong direction, i.e., incorrect fitting is prevented. As shown in FIG. 11, it is preferable that a width dimension (a dimension in the y-direction) w3 of the first convex fitting part 300*a* and a width dimension (a dimension in the y-direction) w4 of the second convex fitting part 300*b* be different from each other. In the shown example, the width dimension w3 of the first convex fitting part 300*a* is larger than the width dimension w4 of the second convex fitting part 300*b*. It is preferable that a length dimension (a dimension in the x-direction) l3 of the first convex fitting part 300*a* and a length dimension (a dimension in the x-direction) l4 of the second convex fitting part 300*b* be different from each other. In the shown example, the length dimension l3 of the first convex fitting part 300*a* is smaller than the length dimension l4 of the second convex fitting part 300*b*. The length dimension of the first convex fitting part may be equal to or larger than the length of the second convex fitting part. Thus, in the shown example, the width dimension w3 of the first convex fitting part 300*a* and the width dimension w4 of the second convex fitting part 300*b*, as well as the length dimension l3 of the first convex fitting part 300*a* and the length dimension l4 of the second convex fitting part 300*b*, are varied from each other, so that the first convex fitting part 300*a* and the second convex fitting part 300*b* have different shapes.

Back to FIG. 1 and FIG. 2, the third and fourth covers 340, 360 partially cover the ends of the second housing 300 in the longitudinal direction. Thus, the ends of the second housing 300 in the longitudinal direction are reinforced. The third and fourth covers 340, 360 function also as fixing tabs for fixing the second housing 300 to the substrate.

Figure 12A:
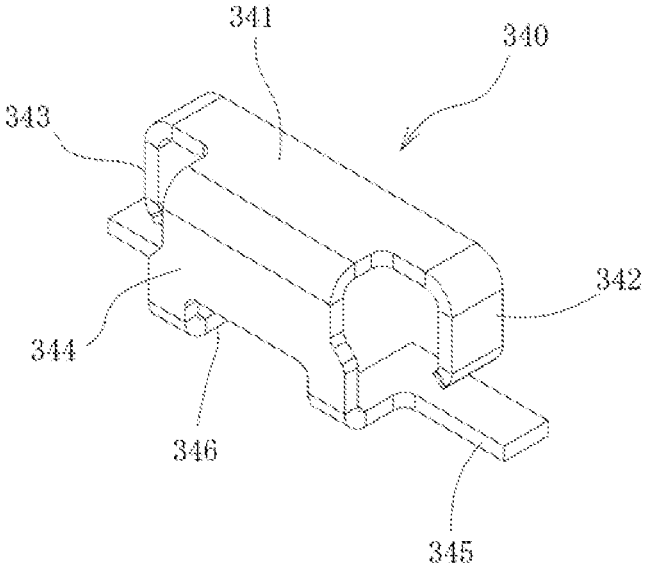
FIG. 12 shows a third cover of the plug connector of FIGS. 1 and 2, with FIG. 12(*a*) being a perspective view of an upper surface side and FIG. 12(*b*) being a perspective view of a bottom surface side.
Figure 12B:
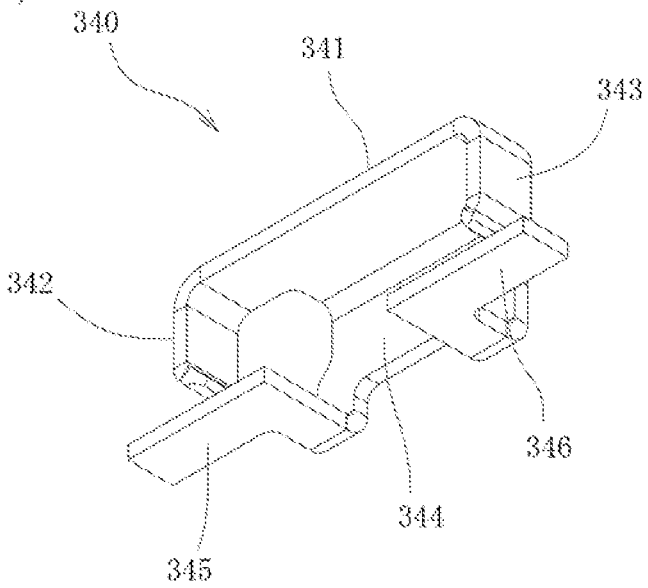

FIG. 12 shows the third cover 340 alone. The third cover 340 is integrated at the time of injection shaping of the second housing 300. Specifically, the third cover 340 is fixed to the second housing 300 by retaining the third cover 340 as an insert body in a mold (not shown) and injecting the synthetic resin material of the second housing 300 around the third cover 340. Instead of this, the third cover 340 may be fixed to the second housing 300 by fitting and/or bonding after the second housing 300 is formed.

The third cover 340 is formed by bending a sheet member that is made of metal, such as copper or copper alloy, and cut into a predetermined shape with predetermined dimensions. The third cover 340 is formed so as to cover the first convex fitting part 300*a* of the second housing 300 by five surfaces (an upper surface, a bottom surface, a right side surface, a left side surface, and a longitudinal direction end surface). The third cover 340 has: a first upper plate 341 that is formed on an upper surface of the second housing 300; first and second downward-bent tongues 342, 343 that bend downward from both sides of the first upper plate 341 and are formed on side surfaces of the second housing 300; a first end piece 344 that bends downward from an end of the first upper plate 341 on the opposite side from the recessed part 301 and is formed on a perpendicular end surface of the second housing 300; and first and second fixing plates 345, 346 that have a substantially L-shape as seen in a plan view, extend from a lower end of the first end piece 344 toward the recessed part 301, and are fixed to the substrate at the time of mounting. The first and second fixing plates 345, 346 are partially embedded into the second housing 300.

Figure 13A:
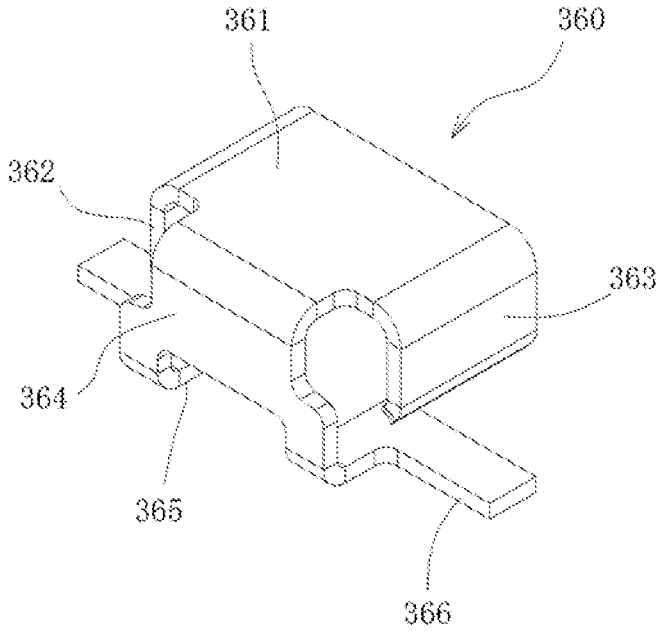
FIG. 13 shows a fourth cover of the plug connector of FIGS. 1 and 2, with FIG. 13(*a*) being a perspective view of an upper surface side and FIG. 13(*b*) being a perspective view of a bottom surface side.
Figure 13B:
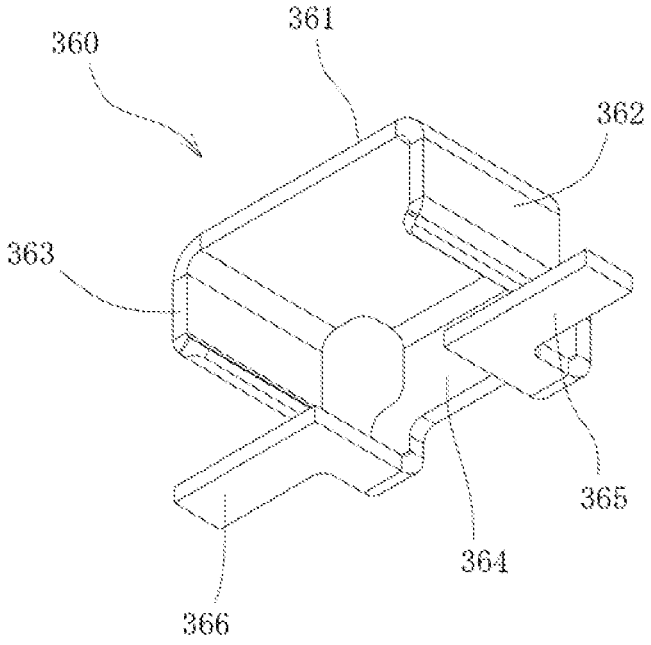

FIG. 13 shows the fourth cover 360 alone. The fourth cover 360 is integrated at the time of injection shaping of the second housing 300. Specifically, the fourth cover 360 is fixed to the second housing 300 by retaining the fourth cover 360 as an insert body in a mold (not shown) and injecting the synthetic resin material of the second housing 300 around the fourth cover 360. Instead of this, the fourth cover 360 may be fixed to the second housing 300 by fitting and/or bonding after the second housing 300 is formed.

The fourth cover 360 is formed by bending a sheet member that is made of metal, such as copper or copper alloy, and cut into a predetermined shape with predetermined dimensions. The fourth cover 360 is formed so as to cover the second convex fitting part 300*b* of the second housing 300 by five surfaces. The fourth cover 360 has: a second upper plate 361 that is formed on the upper surface of the second housing 300; third and fourth downward-bent tongues 362, 363 that bend downward from both sides of the second upper plate 361 and are formed on the side surfaces of the second housing 300; a second end piece 364 that bends downward from an end of the second upper plate 361 on the opposite side from the recessed part 301 and is formed on a perpendicular end surface of the second housing 300; and third and fourth fixing plates 365, 366 that have a substantially L-shape as seen in a plan view, extend from a lower end of the second end piece 364 toward the recessed part 301, and are fixed to the substrate at the time of mounting. The third and fourth fixing plates 365, 366 are partially embedded into the second housing 300. The width dimension (the length in the y-direction) of the second upper plate 361 is smaller than the width dimension (the length in the y-direction) of the first upper plate 341. The length dimension (the length in the x-direction) of the second upper plate 361 is larger than the length dimension (the length in the x-direction) of the first upper plate 341.

Figure 14A:
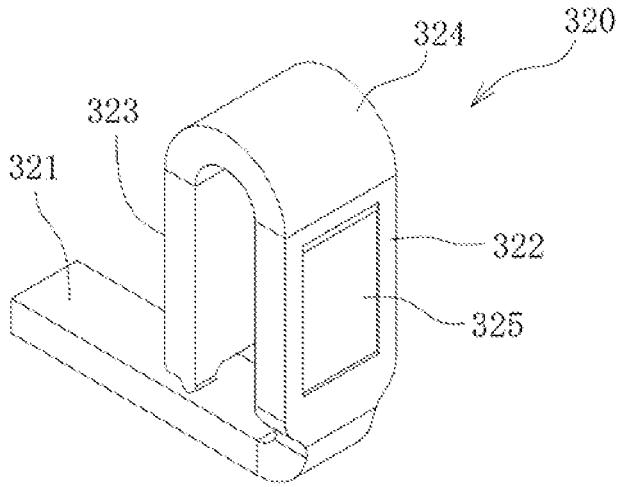
FIG. 14 shows a narrow-type second contact of the plug connector of FIGS. 1 and 2, with FIG. 14(*a*) being a perspective view of an upper surface side and FIG. 14(*b*) being a perspective view of a bottom surface side.
Figure 14B:
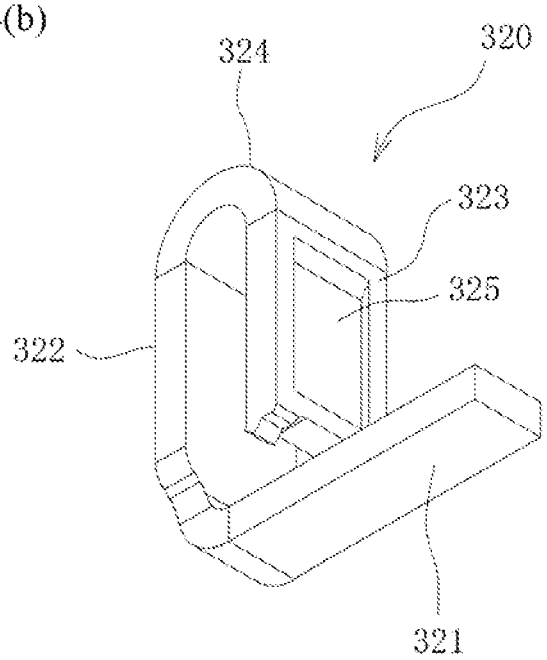
Figure 15A:
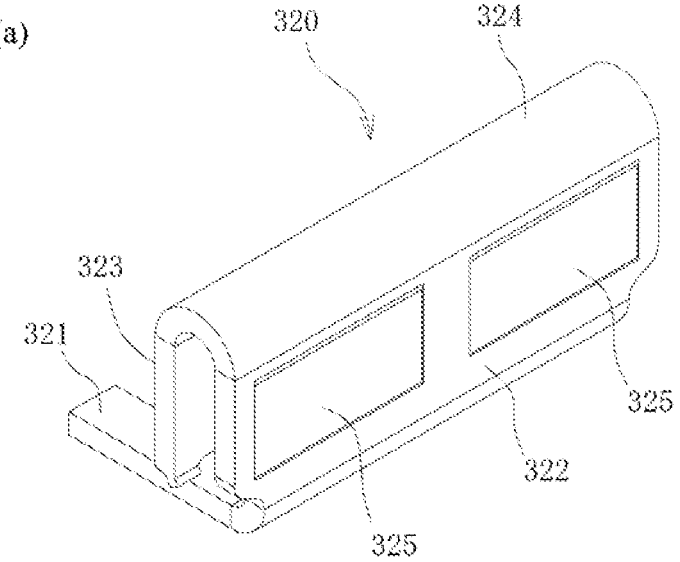
FIG. 15 shows a wide-type second contact of the plug connector of FIGS. 1 and 2, with FIG. 15(*a*) being a perspective view of an upper surface side and FIG. 15(*b*) being a perspective view of a bottom surface side.
Figure 15B:
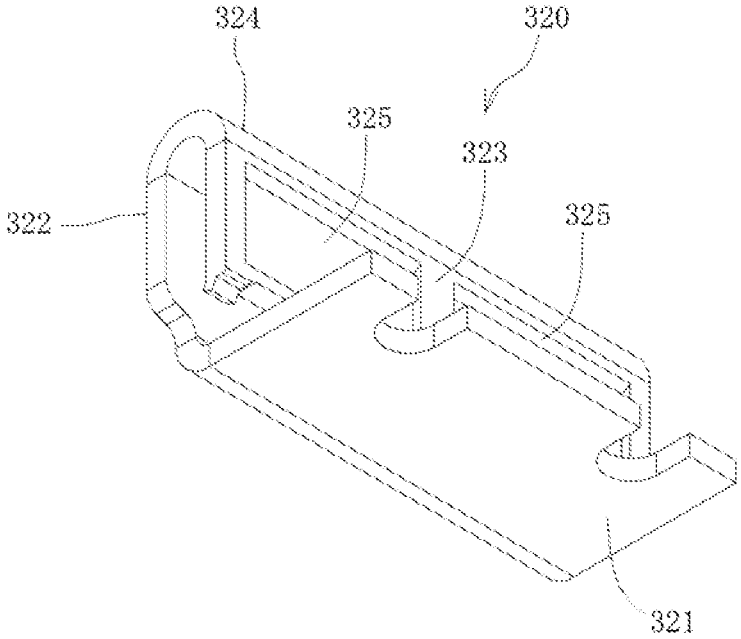
Figure 16A:
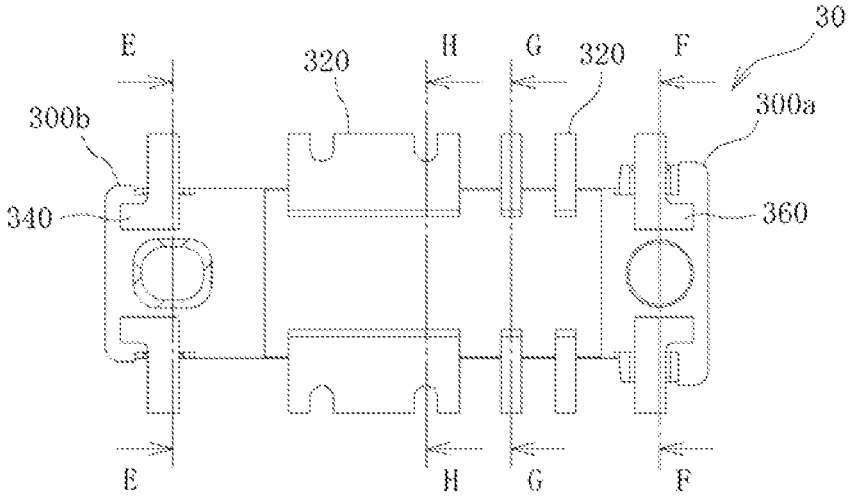
FIG. 16 shows the plug connector in the electrical connector of FIGS. 1 and 2, with FIG. 16(*a*) being a bottom view, FIG. 16(*b*) being a sectional view taken along line E-E in FIG. 16(*a*), FIG. 16(*c*) being a sectional view taken along line F-F in FIG. 16(*a*), FIG. 16(*d*) being a sectional view taken along line G-G in FIG. 16(*a*), and FIG. 16(*e*) being a sectional view taken along line H-H in FIG. 16(*a*).
Figure 16B:
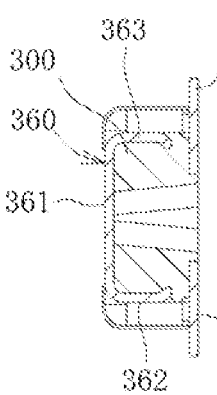
Figure 16C:
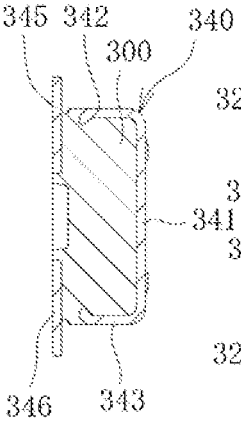
Figure 16D:
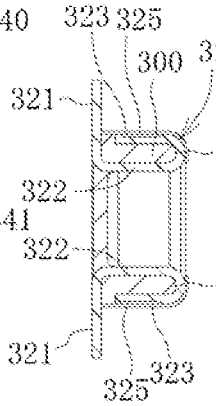
Figure 16E:
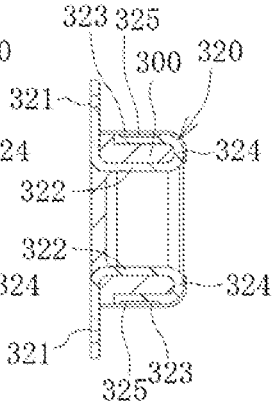
Figure 17A:
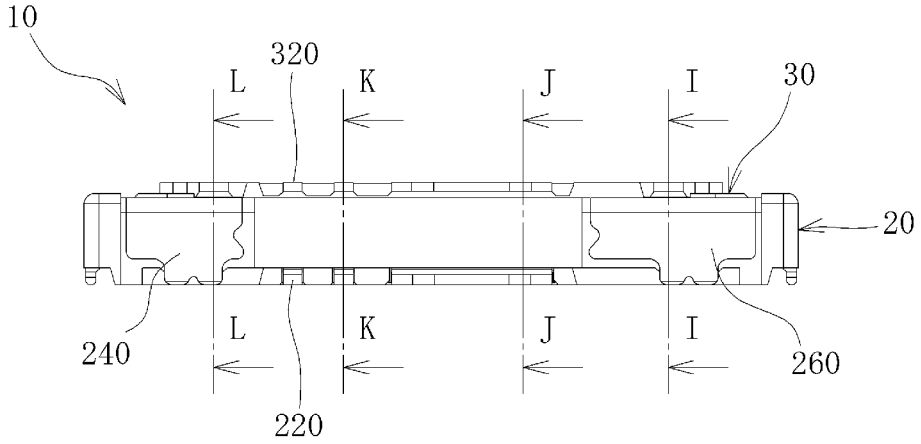
FIG. 17 shows the electrical connector of FIGS. 1 and 2, with FIG. 17(*a*) being a side view, FIG. 17(*b*) being a sectional view taken along line I-I in FIG. 17(*a*), FIG. 17(*c*) being a sectional view taken along line J-J in FIG. 17(*a*), FIG. 17(*d*) being a sectional view taken along line K-K in FIG. 17(*a*), and FIG. 17(*e*) being a sectional view taken along line L-L in FIG. 17(*a*).
Figure 17B:
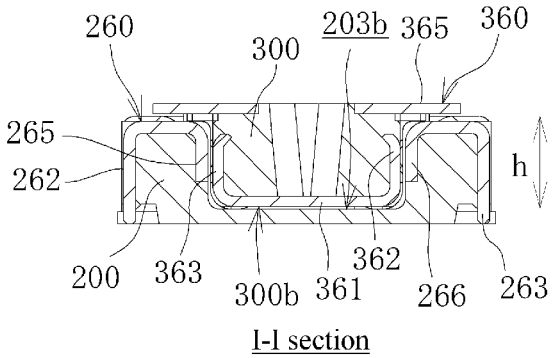
Figure 17C:
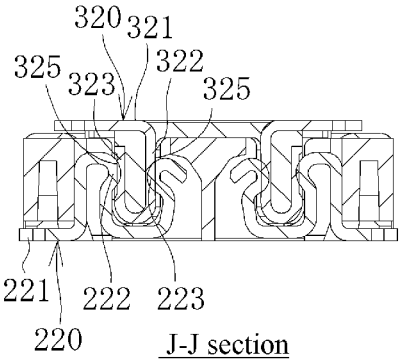
Figure 17D:
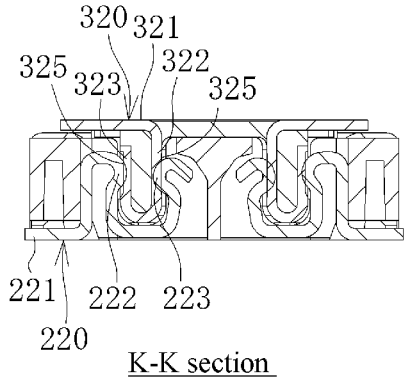
Figure 17E:
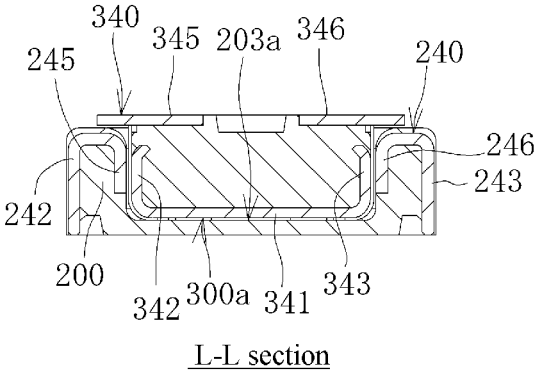

The second contact 320 may include a narrow signal contact as shown in FIG. 14 and a wide power source contact as shown in FIG. 15. The signal contact and the power source contact may have the same width. The second contact 320 are made of conductive metal, for example, copper or copper alloy. The second contact 320 has: a second connecting part 321 to be mounted to the substrate; a third contacting part 322 that rises from the second connecting part 321 and can come into contact with the second contacting part 223 of the first contact 220; a fourth contacting part 323 that is formed such that the side walls 302*a*, 302*b* of the second housing 300 are held between the third contacting part 322 and the fourth contacting part 323, and that can come into contact with the first contacting part 222 of the first contact 220; and a second coupling part 324 that is formed by a substantially C-shaped leaf spring and elastically couples the third and fourth contacting parts 322, 323 to each other.

The second contacts 320 are integrated with the second housing 300 at the time of injection shaping of the second housing 300. Specifically, the second contacts 320 are fixed to the second housing 300 by retaining the second contacts 320 as insert bodies in a mold (not shown) and injecting the synthetic resin material of the second housing 300 around the second contacts 320.

To maintain good contact with the first contact 220, the second contact 320 has depressions 325 formed in surfaces of the third and fourth contacting parts 322, 323, with a step interposed between the depressions 325 and the contacting parts 322, 323.

FIG. 16 shows the plug connector 30 in which the third and fourth covers 340, 360 and the second contacts 320 are integrated with the second housing 300. FIG. 16(*a*) is a bottom view of the plug connector 30, FIG. 16(*b*) is a sectional view taken along line E-E in FIG. 16(*a*), FIG. 16(*c*) is a sectional view taken along line F-F in FIG. 16(*a*), FIG. 16(*d*) is a sectional view taken along line G-G in FIG. 16(*a*), and FIG. 16(*e*) is a sectional view taken along line H-H in (a).

It can be seen from FIG. 16(*b*) that the upper surface, the bottom surface, and both side surfaces of the second housing 300 are covered by the fourth cover 360.

It can be seen from FIG. 16(*c*), that the upper surface, the bottom surface, and both side surfaces of the second housing 300 are covered by the third cover 340.

It can be seen from FIGS. 16(*d*) and (*e*) that the gap between the third contacting part 322 and the fourth contacting part 323 of the second contact 320 is filled with the resin of the second housing 300. The depressions 325 in the surfaces of the third contacting part 322 and the fourth contacting part 323 can also be seen.

FIG. 17 shows the electrical connector 10 in a state where the plug connector 30 and the receptacle connector 20 are connected to each other. FIG. 17(*a*) is a side view, FIG. 17(*b*) is a sectional view taken along line I-I in FIG. 17(*a*), FIG. 17(*c*) is a sectional view taken along line J-J in FIG. 17(*a*), FIG. 17(*d*) is a sectional view taken along line K-K in FIG. 17(*a*), and FIG. 17(*e*) is a sectional view taken along line L-L in FIG. 17(*a*).

It can be seen from FIG. 17(*b*) that the fourth cover 360 is fit to and in contact with the second cover 260, with the second convex fitting part 300*b* fit in the second recess fitting part 203*b*.

It can be seen from FIGS. 17(*c*) and (*d*) that the third and fourth contacting parts 322, 323 and the second coupling part 324 of the second contact 320 are press-fit between the first contacting part 222 and the second contacting part 223 of the first contact 220, and that the first contacting part 222 is elastically in contact with the depression 325 of the fourth contacting part 323 while the second contacting part 223 is elastically in contact with the depression 325 of the third contacting part 322.

It can be seen from FIG. 17(*e*) that the third cover 340 is fit to and in contact with the first cover 240, with the first convex fitting part 300*a* fit in the first recess fitting part 203*a*.

According to the electrical connector 10 having the above-described configuration, the first recess fitting part 203*a* and the second recess fitting part 203*b* have different shapes, which can prevent incorrect fitting of the plug connector and the receptacle connector. The peripheral wall 202 of the first housing 200 of which the thickness is reduced to vary the shapes of the first recess fitting part 203*a* and the second recess fitting part 203*b* is covered by the first and second covers 240, 260 that are made of metal and have higher rigidity than the first housing 200, and thus reinforced. Accordingly, it is possible to secure desired rigidity of the receptacle connector 20 while avoiding increasing the size of the first housing 200.

In particular, a high reinforcing effect can be achieved when the thickness of a part of the peripheral wall is reduced such that the width dimension w1 of the first recess fitting part 203*a* becomes larger than the width dimension w2 of the second recess fitting part 203*b*, and this part with the reduced thickness is held by the first cover 240 from both the inner surface and the outer surface.

The preventing effect on incorrect fitting is further enhanced when the length dimensions of the first and second recess fitting parts 203*a*, 203*b* are varied from each other.

The preventing effect on incorrect fitting is further enhanced when the first housing 200 has the raised part 205 on the bottom wall 201 and the raised part 205 is formed asymmetrically with respect to the center c1 of the recess 203 in the longitudinal direction.

Further, when the electrical connector is configured such that the first cover 240 and the third cover 340, and the second cover 260 and the fourth cover 360, come into contact with and are fit to each other when the plug connector 30 and the receptacle connector 20 are connected to each other, the fit height can be reduced while the connection stability is maintained, which in turn allows a reduction in height of the plug connector 30 and the receptacle connector 20. For example, a fit height h (see FIG. 17(*b*)) of not more than 0.7 mm can be achieved.

INDUSTRIAL APPLICABILITY

The present invention can provide an electrical connector that can prevent incorrect fitting of the plug connector and the receptacle connector while meeting the requirement of reducing the size of the electrical connector.

REFERENCE SIGNS LIST

10 Electrical connector
20 Receptacle connector
200 First housing
203 Recess
203*a* First recess fitting part
203*b* Second recess fitting part
205 Raised part
220 First contact
240 First cover
260 Second cover
30 Plug connector
300 Second housing
301 Recessed part
300*a* First convex fitting part
300*b* Second convex fitting part
320 Second contact
340 Third cover
360 Fourth cover

The invention claimed is:

1. An electrical connector comprising a plug connector and a receptacle connector that are detachably fit to each other, characterized in that:

the receptacle connector including:

a first housing having a recess defined by a bottom wall and a peripheral wall rising from the bottom wall, with one end part of the recess in a longitudinal direction of the receptacle connector forming a first recess fitting part adjacent to an end surface of the first housing and an other end part forming a second recess fitting part adjacent to an other end surface of the first housing that opposes the end surface of the first housing in the longitudinal direction; and a required number of first contacts that are arrayed and retained between the first and second recess fitting parts of the first housing;

the plug connector including:

a second housing having a first convex fitting part that is detachably inserted into the first recess fitting part and a second convex fitting part that is detachably inserted into the second recess fitting part; and a required number of second contacts that are arrayed and retained between the first and second convex fitting parts of the second housing and come into contact with the first contacts when the plug connector and the receptacle connector are fit to each other;

the first and second recess fitting parts have different shapes such that, in the longitudinal direction, a thickness of a part of the peripheral wall that protrudes from the end surface of the first housing is different from a thickness of an other part of the peripheral wall that protrudes from the other end surface of the first housing; and the receptacle connector has a first cover that includes a metal and covers a part of the peripheral wall that defines the first recess fitting part, and a second cover that includes a metal and covers an other part of the peripheral wall that defines the second recess fitting part.

2. The electrical connector according to claim 1, wherein the thickness of the part of the peripheral wall that corresponds to the first recess fitting part is smaller than the thickness of the part of the peripheral wall that corresponds to the second recess fitting part such that a width dimension of the first recess fitting part is larger than a width dimension of the second recess fitting part, and the first cover is formed so as to at least partially hold the part of the peripheral wall that corresponds to the first recess fitting part from both an inner surface and an outer surface of the part.

3. The electrical connector according to claim 1, wherein the first and second recess fitting parts are different from each other in a length dimension.

4. The electrical connector according to claim 1, wherein:

the first and second convex fitting parts have different shapes; and the plug connector has a third cover that includes a metal and covers the first convex fitting part and a fourth cover that includes a metal and covers the second convex fitting part.

5. The electrical connector according to claim 4, wherein the first and second convex fitting parts are different from each other in a width dimension and/or a length dimension.

6. The electrical connector according to claim 1, wherein the first housing has a raised part that is formed on the bottom wall, separated from the peripheral wall, and the raised part is formed asymmetrically with respect to a center of the recess in the longitudinal direction.

7. The electrical connector according to claim 1, wherein a fit height of the plug connector and the receptacle connector is not more than 0.7 mm.

8. The electrical connector according to claim 2, wherein a fit height of the plug connector and the receptacle connector is not more than 0.7 mm.

9. The electrical connector according to claim 2, the first housing has a raised part that is formed on the bottom wall, separated from the peripheral wall, and the raised part is formed asymmetrically with respect to a center of the recess in the longitudinal direction.

10. The electrical connector according to claim 2, wherein:

the first and second convex fitting parts have different shapes; and the plug connector has a third cover that is made of metal and covers the first convex fitting part and a fourth cover that includes a metal and covers the second convex fitting part.

11. The electrical connector according to claim 10, wherein the first and second convex fitting parts are different from each other in a width dimension and/or a length dimension.

12. The electrical connector according to claim 2, wherein the first and second recess fitting parts are different from each other in a length dimension.

13. The electrical connector according to claim 12, wherein a fit height of the plug connector and the receptacle connector is not more than 0.7 mm.

14. The electrical connector according to claim 12, wherein the first housing has a raised part that is formed on the bottom wall, separated from the peripheral wall, and the raised part is formed asymmetrically with respect to a center of the recess in the longitudinal direction.

15. The electrical connector according to claim 12, wherein:

the first and second convex fitting parts have different shapes; and the plug connector has a third cover that includes a metal and covers the first convex fitting part and a fourth cover that includes a metal and covers the second convex fitting part.

16. The electrical connector according to claim 15, wherein the first and second convex fitting parts are different from each other in a width dimension and/or a length dimension.

17. The electrical connector according to claim 3, wherein a fit height of the plug connector and the receptacle connector is not more than 0.7 mm.

18. The electrical connector according to claim 3, wherein the first housing has a raised part that is formed on the bottom wall, separated from the peripheral wall, and the raised part is formed asymmetrically with respect to a center of the recess in the longitudinal direction.

19. The electrical connector according to claim 3, wherein:

the first and second convex fitting parts have different shapes; and the plug connector has a third cover that includes a metal and covers the first convex fitting part and a fourth cover that includes a metal and covers the second convex fitting part.

20. The electrical connector according to claim 19, wherein the first and second convex fitting parts are different from each other in a width dimension and/or a length dimension.

* * * * *